US007567157B2

(12) United States Patent
Frank et al.

(10) Patent No.: US 7,567,157 B2
(45) Date of Patent: Jul. 28, 2009

(54) RECTANGULAR COIL MADE OF STRIP-SHAPED SUPERCONDUCTORS CONTAINING HIGH-$T_c$-SUPERCONDUCTOR MATERIAL AND USE THEREOF

(75) Inventors: Michael Frank, Uttenreuth (DE); Peter Kummeth, Herzogenaurach (DE); Adolf Kühn, Röthenbach (DE); Peter Massek, Forchheim (DE); Peter van Haβelt, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 145 days.

(21) Appl. No.: 11/660,904

(22) PCT Filed: Aug. 11, 2005

(86) PCT No.: PCT/EP2005/053960

§ 371 (c)(1),
(2), (4) Date: Feb. 23, 2007

(87) PCT Pub. No.: WO2006/021516

PCT Pub. Date: Mar. 2, 2006

(65) Prior Publication Data

US 2008/0055026 A1 Mar. 6, 2008

(30) Foreign Application Priority Data

Aug. 23, 2004 (DE) ..... 10 2004 040 754

(51) Int. Cl.
*H01F 6/00* (2006.01)

(52) U.S. Cl. ..... 335/216; 505/211; 505/705; 505/879

(58) Field of Classification Search ..... 335/216; 505/211, 705, 879, 880, 230, 231, 430, 431, 505/704, 917, 924; 29/599
See application file for complete search history.

(56) References Cited

U.S. PATENT DOCUMENTS

| | | | | | |
|---|---|---|---|---|---|
| 5,173,678 | A | * | 12/1992 | Bellows et al. | 505/211 |
| 5,206,213 | A | | 4/1993 | Cuomo et al. | |
| 5,312,802 | A | | 5/1994 | Hayashi et al. | |
| 5,318,948 | A | * | 6/1994 | Okada et al. | 505/230 |
| 5,384,197 | A | * | 1/1995 | Koyama et al. | 428/457 |
| 5,387,891 | A | * | 2/1995 | Nick | 335/216 |
| 5,659,277 | A | * | 8/1997 | Joshi et al. | 335/216 |
| 5,798,312 | A | * | 8/1998 | Okada et al. | 505/230 |

(Continued)

FOREIGN PATENT DOCUMENTS

DE 690 28 471 T3 4/1991

(Continued)

OTHER PUBLICATIONS

English language Abstract for DE 198 17 875, previously cited in an Information Disclosure Statement filed on Feb. 23, 2007.

*Primary Examiner*—Ramon M Barrera
(74) *Attorney, Agent, or Firm*—Staas & Halsey LLP

(57) ABSTRACT

A rectangular coil has several successive windings which are made of a strip-shaped super conductor, which contains at least one core which is embedded in a normal conductive matrix material and which is made of a high-$T_c$-super conductor material. The coil is made of a strip-shaped superconductor and does not have additional insulation.

13 Claims, 1 Drawing Sheet

U.S. PATENT DOCUMENTS

| | | | | |
|---|---|---|---|---|
| 5,812,042 | A * | 9/1998 | Maki et al. | 335/216 |
| 5,849,670 | A * | 12/1998 | Nabatame et al. | 505/230 |
| 5,914,647 | A * | 6/1999 | Aized et al. | 335/216 |
| 6,194,985 | B1 * | 2/2001 | Tanaka et al. | 335/216 |
| 6,397,454 | B1 | 6/2002 | Seuntjens et al. | |
| 6,603,379 | B1 | 8/2003 | Manlief et al. | |
| 2002/0058143 | A1 * | 5/2002 | Hunt et al. | 428/412 |
| 2002/0176943 | A1 | 11/2002 | Pereira | |
| 2003/0210053 | A1 * | 11/2003 | Morita et al. | 324/318 |

FOREIGN PATENT DOCUMENTS

| | | | |
|---|---|---|---|
| DE | 42 43 439 | A1 | 6/1994 |
| DE | 691 03 054 | T2 | 7/1994 |
| DE | 198 17 875 | C2 | 7/1999 |
| DE | 199 43 783 | A1 | 3/2001 |
| EP | 0 736 914 | A | 10/1996 |
| EP | 0 772 208 | A | 5/1997 |
| EP | 1 261 117 | A | 11/2002 |
| WO | WO95/20228 | A1 | 7/1995 |
| WO | WO01/20756 | A1 | 3/2001 |

* cited by examiner

RECTANGULAR COIL MADE OF STRIP-SHAPED SUPERCONDUCTORS CONTAINING HIGH-$T_c$-SUPERCONDUCTOR MATERIAL AND USE THEREOF

CROSS REFERENCE TO RELATED APPLICATIONS

This application is based on and hereby claims priority to Application No. PCT/EP2005/053960 filed on Aug. 11, 2005 and German Application No. 10 2004 040 754.1 filed on Aug. 23, 2004, the contents of which are hereby incorporated by reference.

BACKGROUND

The invention relates to a rectangular coil having a plurality of turns which are located adjacent to one another and are composed of a superconductor in the form of a strip, which contains at least one core which is embedded in a normally conductive matrix material and is composed of high-$T_c$ superconductor material. A corresponding coil is disclosed in WO 01/20756 A1.

In order to allow high-$T_c$ superconductors in the form of a strip (referred to in the foreign text as HTS conductors) to be used in particular in rotating electrical machines, for example according to the WO-A1 document cited above, it is necessary for this conductor to be processed to form coils. Planar coil types are preferably used for this purpose, in particular of the so-called rectangular type. This should be understood as covering all coil types which at least approximately occupy a rectangular footprint, although they may also have rounded corners. Rectangular coils with rounded corners which each together at the end form semicircular curved parts, which may be connected by straight web parts, are also referred to as "racetrack coils". In this case, appropriate coils are based on coils formed using known copper technology, which are intrinsically electrically insulated from the environment. Particularly because of the requirements for accelerator technology and magnetic-resonance technology, where stringent demands are placed on the field quality which allow errors only in the sub-ppm range for the current, standard superconducting racetrack coils have been used until now, which are produced by their conductors being electrically insulated within the individual turns, and electrically insulated from ground.

Known rectangular coils using HTS conductors in the form of a strip have until now been produced using insulated conductor material. At the moment, there are three normal methods for insulation, specifically:

a. lacquer insulation, for example a UV lacquer coating (see EP 1 075 030 A2), b. a Capton-wrap sheath (see DE 38 23 938 A1), or c. a PEEK extrusion coating (see WO 01/61712 A1).

However, appropriate methods are relatively complex, increase the production costs of the conductors, and conceal the risk of conductor damage.

SUMMARY

One possible object of the present invention is therefore to provide a rectangular coil having the features cited initially, but which does not have the abovementioned difficulties.

The inventors propose a rectangular coil having the features mentioned initially should accordingly be formed from the superconductor which is produced and is in the form of a strip, without any additional insulation processes. Corresponding coils can preferably be used for electrical machines.

The inventors believe that no special insulation process is required to form rectangular coils using HTS conductors in the form of a strip. This means that the aim is to dispense with additional insulation after the production of the conductors. The rectangular coil should accordingly be wound from an uninsulated conductor. The major advantage over the use of insulated conductor material is thus on the one hand the reduction in the risk of damage by the insulation process, and on the other hand the reduction in the conductor costs. Since a coil manufactured with conductors such as these need not be insulated from ground, there is also no need for the insulation tests that were previously required for this purpose during coil manufacture. This likewise leads to a corresponding cost reduction.

The coil can accordingly be designed as follows:

The superconductor which is produced has a coating, by virtue of its production, composed of an oxide material on at least one side. In particular, this material may be $Al_2O_3$.

Alternatively, the superconductor which is produced may be contaminated during production in the formation on its outer surfaces, in particular by not subjecting the superconductor that has been produced to any cleaning process.

The coil may be designed for a maximum power loss of 10 W, with a shunt resistance of at least 100 mΩ being present.

A contact resistance between adjacent turns of at least 10 μΩ, preferably 20 μΩ, can preferably be achieved.

The coil is advantageously used in an electrical machine. Because of the lack of insulation, it has a correspondingly high turns density in this case.

BRIEF DESCRIPTION OF THE DRAWINGS

These and other objects and advantages will become more apparent and more readily appreciated from the following description of the preferred embodiments, taken in conjunction with the accompanying drawings of which.

DETAILED DESCRIPTION OF THE PREFERRED EMBODIMENT

Figure 1:
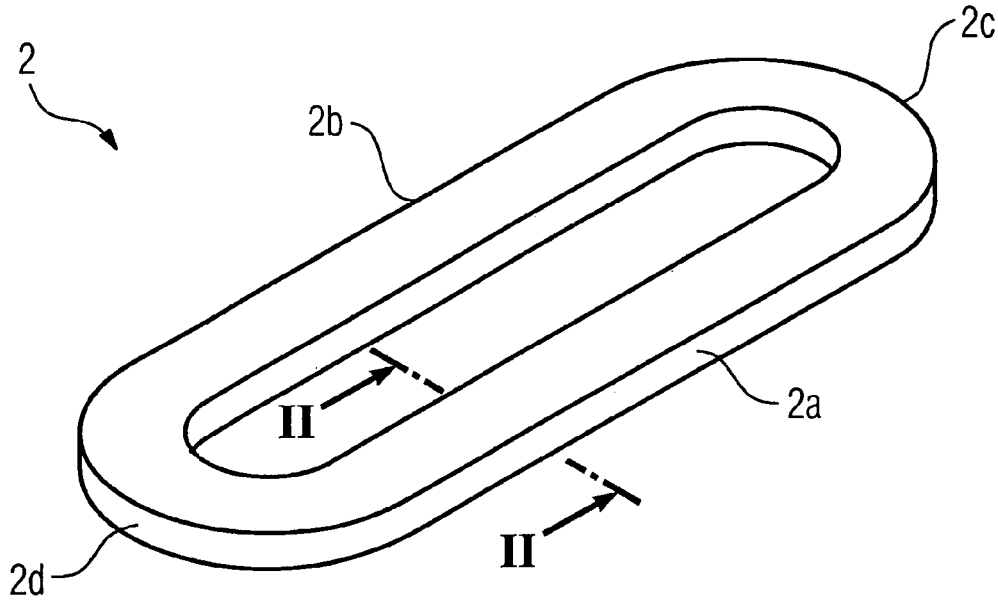
FIG. 1 shows an oblique view of the rectangular coil of the racetrack type.

Reference will now be made in detail to the preferred embodiments, examples of which are illustrated in the accompanying drawings, wherein like reference numerals refer to like elements throughout.

The coil which is only indicated in FIG. 1 but is annotated in general 2 is particularly suitable for formation of the field winding of an electrical machine (see the initially cited WO-A1 document). It is intended to be of the so-called rectangular type. In this context, the expression corresponding rectangular coil is intended to mean any flat coil or (partial) winding which occupies an at least approximately rectangular area. In general, the coil has rounded corners. According to the described exemplary embodiment, the coil 2 is of the so-called racetrack type. It therefore has straight side parts 2*a* and 2*b*, which merge into one another via, for example semicircular, curved parts 2*c* and 2*d* at the ends. The coil is intended to be formed with at least one conductor in the form of a strip composed of one of the known oxide high-$T_c$ superconductor materials (HTS materials) such as $YBa_2Cu_3O_{7-x}$, $Bi_2Sr_2CaCu_2O_{8+x}$ or $(Bi_1Pb)_2Sr_2Ca_2Cu_3O_{10+x}$. In this case, this may be a conductor with HTS mono filaments or multifilaments enclosed by a normally conductive casing or matrix, composed, for example, of silver or of a silver alloy. Corresponding conductors which are known per se have a high aspect ratio (=conductor width/conductor thickness) of at least 3, preferably of at least 10. The HTS conductors must in particular be kept at a temperature level of at most 77 K (boiling point of liquid nitrogen), but in particular below this.

Furthermore, the HTS conductors in the form of strips should be curved to form the turns of the coil in their "easy direction", that is to say over their broad face. This avoids unacceptable strain during bending, and reductions in the current-carrying capacity associated with this. Corresponding HTS conductors with one or more superconducting conductor coils (monofilaments or multifilament conductors) are generally known. In this case, conductors with a casing composed of a silver alloy such as AgMg or AgPd are less sensitive in terms of the winding technique. The conductors in the coil 2 can be fixed by an encapsulation technique, that is known per se, using a curable plastic in a plurality of layers of turns.

A corresponding HTS conductor in the form of a strip should not be subjected to any special insulation process after its production process, before it is used to produce the rectangular coil.

Figure 2:
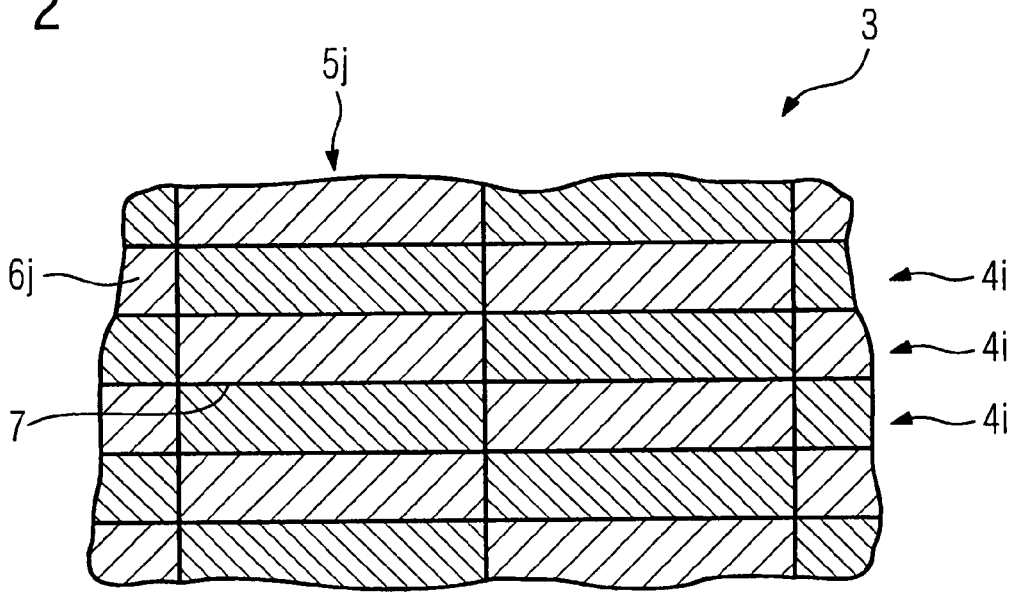
FIG. 2 shows a detail from the winding of this coil.

FIG. 2 shows a cross section through a subarea of the structure, which is annotated in general with 3, of a rectangular coil produced with at least one such HTS conductor. The coil has a plurality of 5*j*, composed of the HTS conductor or conductor 6*j* in the form of a strip or strips, in a plurality of layers 4*i* located one on top of the other. Uncleaned HTS ribbon conductors can preferably be used for winding of the racetrack coil. It can then be assumed that relatively high shunt resistances are then formed between adjacent ribbon conductors 6*j*, for example on boundary surfaces 7. In particular, this can also be a result of the fact that corresponding HTS conductors must, during production, be provided on one side with an insulating material such as an Al2O3 coating in order in this way to avoid adjacent turns of the conductor being baked to one another in an oven during the annealing process that is required. The conductors must then first of all have this insulating layer removed from them in order to make contact with the ends of the winding. If impregnation with a curable plastic is also provided, for example with a resin which is used to produce the coil and/or to fix it within a machine by a wet-winding technique, then this result in a coating on the conductors which ensures sufficiently good insulation between the turns and from ground A number of estimates will be considered in the following text in order to assess the affect associated with the structure described herein: for a typical application, for example for the rotary winding of a synchronous machine, the rotor current is 100 A. A fault current of 1%, that is to say of 1 A, can in this case easily be compensated for in general by an increase in the current from an excitation machine, and the fields caused by the fault current are irrelevant for motor applications. The coils are in the superconductive state during operation. For financial reasons a maximum power loss of 10 W is permitted in realistic embodiments for the coils according to the application being considered at present. This then results in a voltage drop of 100 mV over the entire length of the rotor winding. The resistance (short-circuit or shunt resistance) which may result from the use of uninsulated conductors should therefore not be less than a value of 100 mΩ. By way of example, a complete rotor winding is composed of approximately 25 coil elements. A voltage of about 4 mV is then dropped across each coil element, so that the (short-circuit or shunt) resistance must not fall below a value of about 4 mΩ for each coil element. If it is assumed that each of these coils is composed of about 100 turns, the permissible resistance between two adjacent turns is reduced to about 40 μΩ. There should always be a contact resistance between adjacent turns 5*j* in the coil of at least 10 μΩ, preferably 20 μΩ. If these resistances are not undershot, then a current of about 1 A flows through the resultant shunt path. This means that this shunt current is in the permissible order of magnitude.

In order to allow the shunt resistances as outlined above to be estimated in a design 3 as shown in FIG. 2, reference will be made for comparative purposes to a known 2 mm plug connection for 6 A, whose through-resistances are up to about 6 mΩ. If, for example, one considers switching contacts for relays, contact resistances of several 100 mΩ occur there. Furthermore, specific measures have been taken in these known devices in order to keep the contact resistances as low as possible. Nevertheless, they are in the same order of magnitude as that which would cause an error of only about 1% in the current in the above estimate. This means that, in the case of the coil design, it can be assumed that if no special cleaning measures are carried out, then sufficiently high shunt resistances will be present between adjacent turns 5*j*.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in Superguide v. DIRECTV, 358 F3d 870, 69 USPQ2d 1865 (Fed. Cir. 2004).

The invention claimed is:

1. A superconductive machine comprising:

a plurality of stacked coil elements, each of the stacked coil elements formed from a high-$T_c$ superconductor inner core which is embedded in a normally conductive matrix material outer core; and each of the stacked coil elements having a plurality of turns such that the stacked coil element is continuous and approximately planar within a plane, with a first end of each of the stacked coil elements joining a second end of each of the stacked coil elements opposite the first end, the stacked coil element having a width greater than a height, the width of the stacked coil element extending approximately parallel to the plane of the stacked coil element, wherein each of the stacked coil elements is disposed substantially proximate to at least one other of the stacked coil elements;

each of the stacked coil elements is produced in the form of a strip, without any additional process to form insulation thereon, each of the stacked coil elements is contaminated on its outer surfaces during production, and there is a contact resistance of at least 10 μΩ between adjacent stacked coil elements.

2. The machine as claimed in claim 1, wherein when each coil element is contaminated, an oxide coating is formed on at least one side.

3. The machine as claimed in claim 2, wherein the oxide coating is $Al_2O_3$.

4. The machine as claimed in claim 1, wherein the coil elements are not cleaned after being produced.

5. The machine as claimed in claim 1, wherein the stacked coil elements are impregnated with synthetic resin using wet-winding technology.

6. The machine as claimed in claim 1, wherein the stacked coil elements together have a maximum power loss of 10 W, and a shunt resistance of at least 100 mμ.

7. The machine as claimed in claim 1, wherein the contact resistance between adjacent stacked coil elements is at least 20 μΩ.

8. The machine as claimed in claim 1 wherein the core and the stacked coil element serve as a magnet for an accelerator device or a magnetic-resonance device.

9. The machine as claimed in claim 3, wherein the coil elements are not cleaned after being produced.

10. The machine as claimed in claim 9, wherein the stacked coil elements are impregnated with synthetic resin using wet-winding technology.

11. The machine as claimed in claim 10, wherein the stacked coil elements together have a maximum power loss of 10 W, and a shunt resistance of at least 100 mΩ.

12. The machine as claimed in claim 11, wherein the contact resistance between adjacent stacked coil elements is at least 20 μΩ.

13. The machine as claimed in claim 12 wherein the plurality of stacked coil elements serves as a magnet for an accelerator device or a magnetic-resonance device.

* * * * *